United States Patent [19]

Otobe et al.

[11] Patent Number: 4,700,679

[45] Date of Patent: Oct. 20, 1987

[54] INTAKE AIR QUANTITY CONTROL METHOD FOR INTERNAL COMBUSTION ENGINES

[75] Inventors: Yutaka Otobe, Shiki; Akira Kato, Itabashi; Fumio Hosoda, Utsunomiya; Akinobu Takagi, Yokohama, all of Japan

[73] Assignee: Honda Giken Kogyo K.K., Tokyo, Japan

[21] Appl. No.: 868,127

[22] Filed: May 28, 1986

[30] Foreign Application Priority Data

May 29, 1985 [JP] Japan ..... 60-114282
Jun. 3, 1985 [JP] Japan ..... 60-120306

[51] Int. Cl.[4] ..... F02M 23/06
[52] U.S. Cl. ..... 123/327; 123/585
[58] Field of Search ..... 123/327, 585, 589

[56] References Cited

U.S. PATENT DOCUMENTS 4,526,144 7/1985 Hasegawa et al. ..... 123/327
4,569,318 2/1986 Fujimura et al. ..... 123/327
4,572,141 2/1986 Hasegawa et al. ..... 123/585
4,594,977 6/1986 Shimamura et al. ..... 123/327

FOREIGN PATENT DOCUMENTS 87261 5/1984 Japan ..... 123/327

*Primary Examiner*—William A. Cuchlinski, Jr.
*Attorney, Agent, or Firm*—Arthur L. Lessler

[57] ABSTRACT

A method for controlling the flow rate of supplementary air supplied to an internal combustion engine via at least one supplementary air passage bypassing a throttle valve arranged in the intake air passage, by means of at least one control valve arranged across the at lease one supplementary air passage. The valve opening of the control valve is decreased with a decrease in the engine rotational speed, when the throttle valve is detected to be in a substantially fully closed position and at the same time the engine rotational speed is higher than a predetermined value which is higher than an idling speed of the engine. Preferably, the at least one supplementary air passage comprises a plurality of air passages, and the at least one control valve comprises a plurality of on-off valves arranged across respective ones of the air passages. One or more of the on-off valves are selectively opened in response to the extent of engine warming-up and/or an increase in engine load.

8 Claims, 7 Drawing Figures

INTAKE AIR QUANTITY CONTROL METHOD FOR INTERNAL COMBUSTION ENGINES

BACKGROUND OF THE INVENTION

This invention relates to an intake air quantity control method for internal combustion engines, and more particularly to a method of this kind which is intended to mitigate a vacuum created in an intake passage downstream of a throttle valve therein, when the engine is decelerating, to thereby prevent lubricating oil loss, and also to stabilize engine idling rotation upon an increase in engine load.

In an internal combustion engine for automotive vehicles, when the engine is in certain conditions such as at deceleration, the engine is reversely driven by the driving wheels through the power transmission system, involving a problem that a high vacuum is created in the intake passage downstream of a throttle valve therein. This vacuum causes lubricating oil in an oil pan of the engine to be drawn up into the combustion chambers of cylinders, as well as causes lubricating oil in the valving system in the cylinder head to be drawn into the combustion chambers passing around valve stems mounted in the cylinder head, resulting in increased oil consumption. When the engine is in a warming-up condition, sliding portions of the engine have increased friction, and hence the engine rotation is unstable. Also, during idling the engine rotational speed is so low that an increase in engine load would render the engine rotation unstable.

SUMMARY OF THE INVENTION

It is the object of the invention to mitigate a vacuum created in an intake passage downstream of a throttle valve therein, when the engine is in a decelerating condition to thereby prevent lubricating oil from being drawn into the combustion chambers and also to stabilize engine rotation when the engine is in a warming-up condition or when increased load is applied on the engine during idling.

According to the invention, an intake air quantity control method is provided for an internal combustion engine having an intake passage, a throttle valve arranged in the intake passage, at least one supplementary air passage bypassing the throttle valve, and control valve means arranged across the at least one supplementary air passage for controlling the flow rate of supplementary air supplied therethrough to the engine.

The method according to the invention comprises the following steps: (1) detecting the valve opening of the throttle valve; (2) detecting the rotational speed of the engine; and (3) controlling the control valve means in a manner such that the valve opening of the control valve means is decreased with a decrease in the rotational speed of the engine, when it is determined from the detected valve opening of the throttle valve that the throttle valve is in a substantially fully closed position and at the same time the rotational speed of the engine is higher than a predetermined value which is higher than an idling speed of the engine.

Preferably, the at least one supplementary air passage comprises a plurality of air passages, and the control valve means comprises a plurality of on-off valves arranged across respective ones of the air passages, the step (3) comprising selectively opening at least one of the plurality of on-off valves such that the total opening of the opened on-off valves decreases with a decrease in the rotational speed of the engine.

Also preferably, the plurality of on-off valves have opening areas different from each other.

More preferably, the plurality of on-off valves each comprise a solenoid and a valve body being displaceable in response to whether or not the solenoid is engergized.

Still more preferably, at least one of the plurality of on-off valves is a vacuum-activated valve.

Further preferably, the method further comprises a step of selectively opening at least one of the plurality of on-off valves in response to an extent to which the engine has been warmed up.

Still more preferably, the method further comprises a step of selectively opening at least one of the plurality of on-off valves in response to an increase in a predetermined load on the engine.

Also preferably, the control valve means comprises a linear solenoid valve.

The above and other objects, features and advantages of the invention will be more apparent from the ensuing detailed description taken in conjunction with the accompanying drawings.

DETAILED DESCRIPTION

The invention will now be described in detail with reference to the drawings illustrating embodiments thereof.

Figure 1:
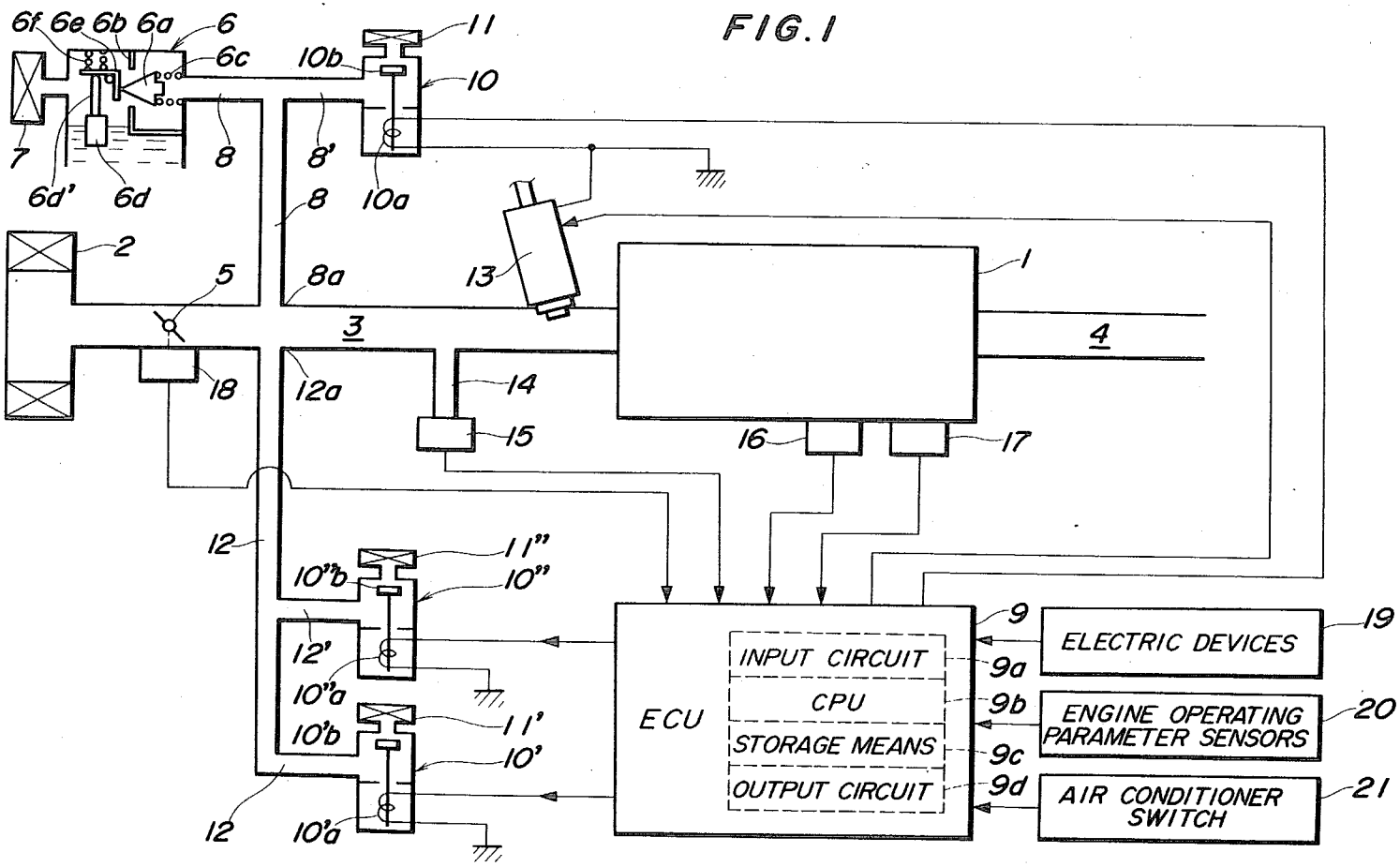
FIG. 1 is a block diagram illustrating the whole arrangement of a first embodiment of an intake air quantity control system to which is applied the method of the invention.

Referring first to FIG. 1, the whole arrangement of a first embodiment of a supplementary air quantity control system for an internal combustion engine is schematically illustrated, to which is applied the method of the invention. Reference numeral 1 designates the internal combustion engine which may be a four-cylinder type, of which an intake side is connected with an intake pipe 3 with an air cleaner mounted at its open end and an exhaust side with an exhaust pipe 4. A throttle valve 5 is arranged within the intake pipe 3. A first supplementary air passage 8 and a second supplementary air passage 12 open at their respective ends 8*a* and 12*a* into the intake pipe 3 at locations downstream of the throttle valve 5 and communicate at the other ends with the atmosphere. The first supplementary air passage 8 is provided with an air cleaner 7 at the open end communicating with the atmosphere, and across which is provided a fast idling control valve 6 for controlling the quantity of supplementary air supplied to the engine 1 through the first supplementary air passage 8. The fast idling control valve 6 comprises, for instance, a valve body 6*a* disposed to be urged against its valve seat 6*b* by a spring 6*c* for closing the first supplementary air passage 8, a sensor means 6*d* adapted to stretch or contract its arm 6*d*′ in response to the engine cooling water temperature, and a lever 6*e* pivotable in response to the stretching and contracting action of the arm 6*d*′ of the sensor means 6*d* for displacing the valve body 6*a* so as to open or close the first supplementary air passage 8.

A third supplementary air passage 8′ branches off from the first supplementary air passage 8 at a location downstream of the fast idling control valve 6, and has its atmosphere-opening end provided with an air cleaner 11. Arranged across the third supplementary air passage 8′ is a first supplementary air control valve (hereinafter called "AIC valve38 ) 10, which controls the quantity of supplementary air supplied to the engine 1 through the air passage 8′. This AIC valve 10 is of normally closed type and comprises a solenoid 10*a* and a valve body 10*b* disposed to open the third supplementary air passage 8′ when the solenoid 10*a* is energized. The solenoid 10*a* has its one end grounded and the other end connected to an electronic control unit (hereinafter called "ECU") 9.

A fourth supplementary air passage 12′ branches off from the second supplementary air passage 12, both of which have their atmosphere-opening ends provided with air cleaners 11′ and 11″. A second supplementary air control valve (hereinafter called "HAC valve") 10′ and a third supplementary air control valve (hereinafter called "ALV valve") 10″, which are both of normally closed type, are arranged, respectively, across a portion of the second air passage 12 between the junction of the same passage with the fourth air passage 12′ and its atmosphere-opening end and across the fourth air passage 12′. These two valves 10′ and 10″ each comprise a solenoid 10′*a*, 10″*a*, and a valve body 10′*b*, 10″*b* disposed to open the corresponding air passage when the solenoid is energized. The solenoids 10′*a* and 10″*a* have their one ends grounded and the other ends connected to the ECU 9.

The opening cross sectional area of the HAC valve 10′ is greater than that of the AIC valve 10, and that of the ALV valve 10″ is at least greater than the sum of those of the AIC valve 10 and the HAC valve 10′, but is by far smaller than that of the fast idling control valve 6. Therefore, when the engine cooling water temperature is lower than a predetermined value, i.e., when the fast idling control valve 6 is open, it is not necessary to energize the other control valves to supply the engine with supplementary air therethrough.

Fuel injection valves 13 are inserted into the intake pipe 3, at a location downstream of the open ends 8*a* and 12*a* of the first and second supplementary air passages 8, 12 and connected to a fuel pump (not shown) and electrically connected to the ECU 9. Also connected to the intake pipe 3 via a passage 14, at a location downstream of the open ends 8*a* and 12*a* but upstream of the fuel injection valve 13, is an intake pipe absolute pressure (PBA) sensor (hereinafter called "absolute pressure sensor") 15, which is also electrically connected to the ECU 9 to supply same with an absolute pressure signal detected thereby.

An engine rotational speed sensor (hereinafter called "Ne sensor") 16 is arranged in facing relation to a camshaft or a crankshaft (neither of which is shown) of the engine 1, and is adapted to generate one pulse each time the engine crankshaft rotates through 180° to assume a predetermined crank angle position in advance of the top dead center (TDC) of each cylinder by a predetermined angle, at which the piston starts its suction stroke. The pulses generated by the Ne 16 are supplied to the ECU 9. An engine cooling water temperature (TW) sensor (hereinafter called "water temperature sensor") 17 is embedded in the peripheral wall of an engine cylinder for applying an electrical output signal indicative of the detected water temperature to the ECU 9. A throttle valve opening ($\theta$th) sensor 18 is connected to the throttle valve 5 for detecting its valve opening and converting same into an electrical signal to be supplied to the ECU 9.

Further connected to the ECU 9 are such electric devices 19 as headlights and brake lights, which are disposed to apply on-off signals to the ECU 9.

In FIG. 1, reference numeral 20 designates other engine operating parameter sensors, such as an atmospheric pressure sensor and an O2 sensor, which supply the ECU 9 with respective detected parameter values in the form of electric signals. Reference numeral 21 designates a switch for activating an air conditioner (not shown), which supplies the ECU 9 with an on-off signal indicative of on-off position of the air conditioner.

The ECU 9 comprises an input circuit 9*a* having functions such as waveform shaping and voltage level shifting for input signals from various sensors into a predetermined voltage value, and converting analog signals from some of the sensors to digital signals, a central processing unit (hereinafter called "the CPU") 9*b*, storage means 9*c* for storing operational programs executed by the CPU 9*b* and results of calculations effected by the CPU 9*b*, and an output circuit 9*d* for supplying driving signals to the fuel injection valves 13 and the control valves 10, 10′, and 10″.

The CPU 9*b* of the ECU 9 operates in synchronism with generation of each top-dead-center (TDC) signal pulse to detect engine operating conditions and engine load conditions based upon engine operating parameter signal values supplied, respectively, from the throttle valve opening sensor 18, the absolute pressure sensor 15, the water temperature sensor 17, and the Ne sensor 16, as well as on-off signals from the electric devices 19 and the air conditioner 20, and calculate a desired quantity of fuel to be supplied to the engine 1, that is, a desired valve opening period of the fuel injection valves 13, as well as a desired quantity of supplementary air to be supplied to the engine 1 via the control valves 10, 10′, 10″ that is, a desired valve opening period of the control valves, on the basis of the detected operating conditions and load conditions of the engine, and then supply driving pulses corresponding to the calculated values to the fuel injection valves 13 and the control valves 10, 10', 10'' via the output circuit 9*d*, to thereby actuate the valves 13, 10, 10', and 10''.

Now, the operation of the first embodiment of the supplementary air quantity control system as constructed above will be described.

The fast idling control valve 6 is adapted to operate when the engine cooling water temperature is lower than a predetermined value (e.g. 60° C.) such as at the start of the engine 1 in cold weather. More specifically, the sensor means 6*d* of the fast idling control valve 6 stretches or contracts its arm 6*d* in response to the engine cooling water temperature. This sensor means 6*d* may comprise any suitable sensing means, such as wax filled in a casing to make use of the thermal expansibility of same. When the engine cooling water temperature is lower than the above predetermined value, the arm 6*d'* of the sensor means 6*d* is in a contracted state, with the lever 6*e* biased by the force of the spring 6*f* in such a position as to displace the valve body 6*a* in a rightward direction, as viewed in FIG. 1, against the force of the spring 6*c* whereby the first supplementary air passage 8 is opened. Since the open first supplementary air passage 8 allows supply of a sufficient amount of supplementary air to the engine 1 through the air cleaner 7 and the passages 8 and 3, the engine speed can be maintained at a higher value than normal idling rpm, thereby ensuring stable idling operation of the engine without the possibility of engine stall even in cold weather.

As the arm 6d' of the sensor means 6*d* is stretched, due to thermal expansion of a material therein, with an increase in the engine cooling water temperature, it pushes the lever 6*e* upward to rotate same in a clockwise direction. Then, the valve body 6*a* is displaced leftward as viewed in FIG. 1, by the force of the spring 6*c*. When the engine cooling water temperature exceeds the predetermined value, the valve body 6*a* eventually comes into urging contact with the valve seat 6*b* to close the first supplementary air passage 8, thereby interrupting the supply of supplementary air through the fast idling control valve 6.

On the other hand, the AIC valve 10 is used for increasing the supplementary air to cope with relatively small electrical loads caused by such electric devices 19 as the headlights and the brake lights during engine idling, and also for precisely controlling the supply of supplementary air to the so as to maintain the engine rotational speed at desired idling rpm. As described above, the solenoid 10*a* of the AIC valve 10 is energized over the valve opening period calculated by the ECU 9, to thereby urge the valve body 10*b* into an open position, whereupon a desired amount of supplementary air is supplied to the engine 1 through the third supplementary air passage 8', the first supplementary air passage 8, and the intake pipe 3.

When the on-off signal indicative of on-state of the air conditioner is supplied to the ECU 9 from the air conditioner switch 21, the ECU 9 supplies a driving signal to the HAC valve 10' via the output circuit 9*d* to energize the solenoid 10'to thereby urge the valve body 10'*b* into an open position, whereupon a predetermined amount of supplementary air, which corresponds to the increase in engine load due to operation of the air conditioner, is supplied to the engine 1 through the second supplementary air passage 12 and the intake pipe 3.

Next, reference is made to FIGS. 2 and 3 to explain the manner of controlling intake air quantity at deceleration of the engine (hereinafter called "intake air quantity control in deceleration vacuum control mode") according to the invention.

Figure 3:
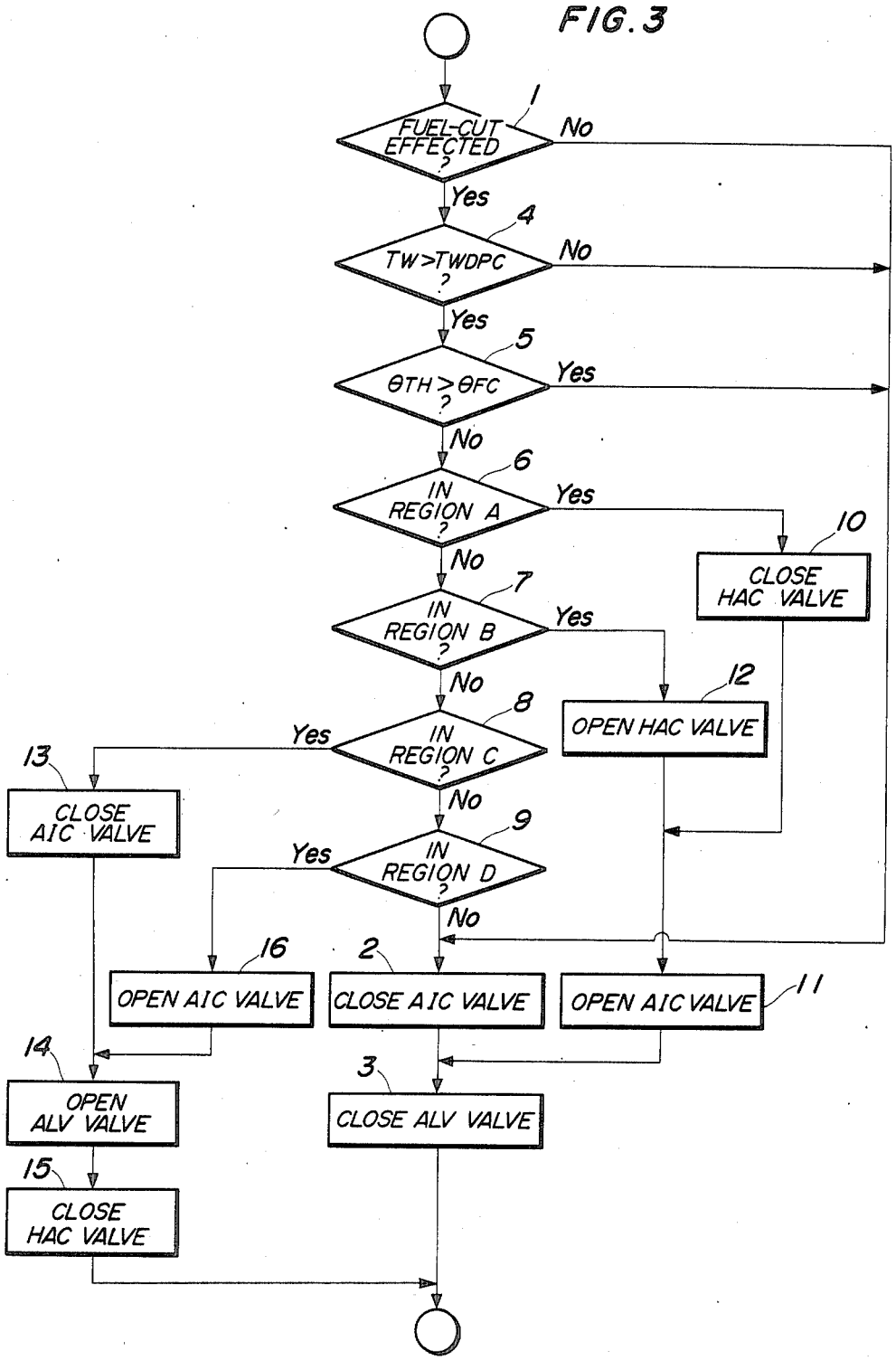
FIG. 3 is a flowchart showing a manner of controlling first, second, and third supplementary air quantity control valves in FIG. 1 in deceleration vacuum control mode.

FIG. 3 is a flowchart showing the program to be executed within the CPU 9*b* of FIG. 1 for controlling on-off states of the AIC valve 10, the HAC valve 10', and the ALV valve 10''.

First, at step 1 it is determined whether or not fuel-cut is being effected upon engine deceleration. This determination is made based, for example, on whether or not the intake pipe absolute pressure PBA is equal to or lower than a predetermined reference value PBAFC, which is selected from a plurality of values of absolute pressure PBA in a manner that the higher the engine rpm the greater the selected value [FIG. 2 (a)]. If the answer to the question at step 1 is No, that is, if fuel is being supplied to the engine 1, it is judged that it is unnecessary to execute the intake air quantity control in deceleration vacuum control mode, whereupon the AIC valve 10 and the ALV valve 10'' are both closed (deenergized) at steps 2 and 3, followed by termination of the program. On this occasion, whether the HAC valve 10' is opened or closed is determined only according to the on-off state of the air conditioner switch 21. If the answer at step 1 is Yes, the program proceeds to step 4, where it is determined whether or not the engine cooling water temperature TW is higher than a predetermined value TWDPC (e.g. 60° C.) If the answer at step 4 is No, it is judged that there is no fear of lubricating oil being drawn up into the combustion chamber, etc. because the engine temperature is so low that the fast idling control valve 6 is open to supply supplementary air to the engine. Then the program is terminated after executing steps 2 and 3. If the answer at step 4 is Yes, it is determined at step 5 whether or not the valve opening $\theta$TH of the throttle valve 5 is greater than a predetermined value $\theta$FC, corresponding to a substantially fully closed position of the throttle valve 5. If the answer at step 5 is Yes, it is judged that it is unnecessary to execute the intake air quantity control in deceleration vacuum control mode because there is no fear of a sudden drop in the absolute pressure within the cylinders as a sufficient amount of intake air flows downstream past the throttle valve 5 in the intake pipe 3, then the program is terminated after executing steps 2 and 3, similarly to the case where the answer at step 4 is No. If the answer at step 5 is No, the program goes to step 6.

Figure 2:
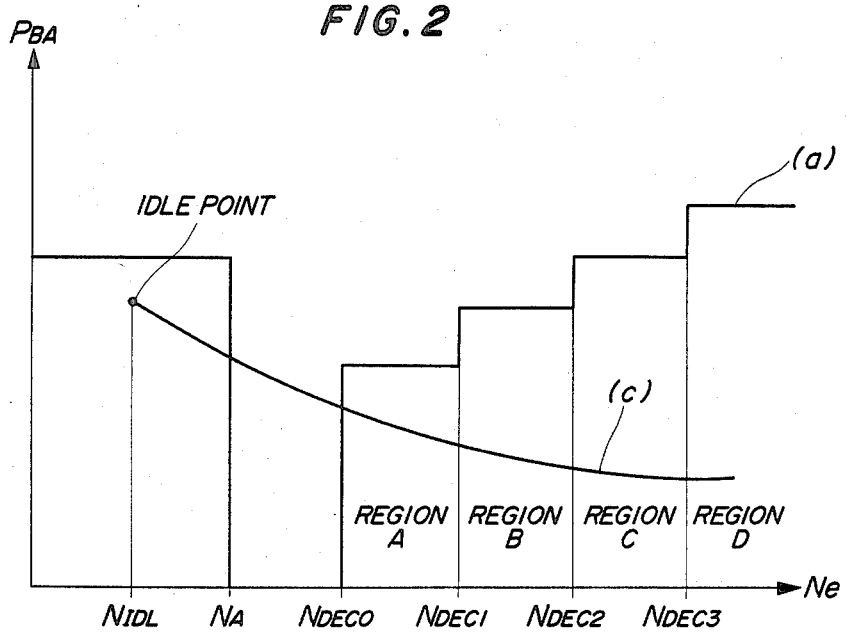
FIG. 2 is a graph showing a plurality of operating regions of the engine defined by intake pipe absolute pressure PBA and engine rotational speed Ne, based on which the intake air quantity control in deceleration vacuum control mode is effected by the control system of FIG. 1.

At steps 6 through 9 it is determined which one of regions A, B, C, and D the value of the engine rotational speed Ne lies in, the operating regions being defined, respectively, by a plurality of predetermined engine rotational speed values NDEC0–NDEC3 as shown in FIG. 2. In response to the result of this determination, the AIC valve 10, HAC valve 10', and the ALV valve 10'' are selectively controlled in a manner as shown in Table 1 below:

TABLE 1

| Regions | A | B | C | D |
|---|---|---|---|---|
| AIC valve | ON | ON | OFF | ON |
| KAC valve | OFF | ON | OFF | OFF |
| ALV valve | OFF | OFF | ON | ON |

More specifically, when the intake air quantity control is carried out in deceleration vacuum control mode, the determinations at steps 6 through 9 should be made in the following manner:

When the engine rotation speed Ne is equal to or greater than a predetermined value NDEC3 (e.g. 5200 rpm), i.e. in the region D, only the answer to the question of step 9 is determined to be Yes, whereupon the AIC valve 10 and the ALV valve 10'' are both opened (at steps 16 and 14, respectively), while the HAC valve 10' is kept closed irrespective of on-off state of the air conditioner switch 21 (step 15). Then as engine rotational speed Ne decreases and enters the region C, which is between predetermined values NDEC3 and NDEC2 (e.g. 4700 rpm), only the answer at step 8 is determined to be Yes, whereupon the AIC valve 10 is closed (step 13), the ALV valve 10'' opened (step 14), and the HAC valve 10' closed (step 15). When the engine roational speed Ne further decreases to enter the region B, which is between predetermined values NDEC2 and NDEC1 (e.g. 4000 rpm), only step 7 provides an affirmative answer or Yes, whereupon the HAC valve 10'and the AIC valve 10 are both opened (respectively at steps 12 and 11), and only the ALV valve 10'' is closed (step 3). Then, as the engine rotational speed Ne enters the region A, which is between predetermined values NDEC1 and NDEC0 (e.g. 3500 rpm), only step 6 provides an affirmative answer or Yes, whereupon the HAC valve 10' is closed (step 10), the AIC valve 10 is opened (step 11), and the ALV valve 10'' is closed (step 3).

When the engine rotational speed Ne further decreases below the region A, the answers at all of the steps 6 through 9 are determined to be No, whereupon the program is terminated after executing steps 2 and 3, similarly to the case where the answer at step 1 is determined to be No. The reason for this is that when the engine rotational speed becomes lower than the predetermined value NDEC0, the absolute pressure in the cylinders gradually decreases whereupon the fear of lubricating oil being drawn up into the combustion chambers, etc. ceases to exist.

Therefore, since in deceleration vacuum control mode, the amount of supplementary air supplied to the engine is set to desired values depending on the engine rotational speed regions in which the engine is operating, the pressure in the cylinders is maintained so high that lubricating oil is prevented from being drawn into the combustion chambers.

Incidentally, it is possible to provide two different predetermined values as each of the predetermined values of the parameters TW, $\theta$TH and Ne used for determinations at steps 1 and 4 through 9, one being applied when the answer turns from No to Yes and the other being applied when the answer turns from Yes to No, that is, to provide hysteresis characteristics for the determiations to thereby stably carry out the intake air quantity control.

In FIG. 2, the solid line (c) shows a variation in the intake pipe absolute pressure PBA with respect to the engine rotational speed, which is assumed with the throttle valve 5 in its fully closed position (i.e. during deceleration) in the case where the method of the invention is not applied. It is seen that the intake pipe absolute pressure PBA decreases as the engine rotational speed Ne increases.

Figure 4:
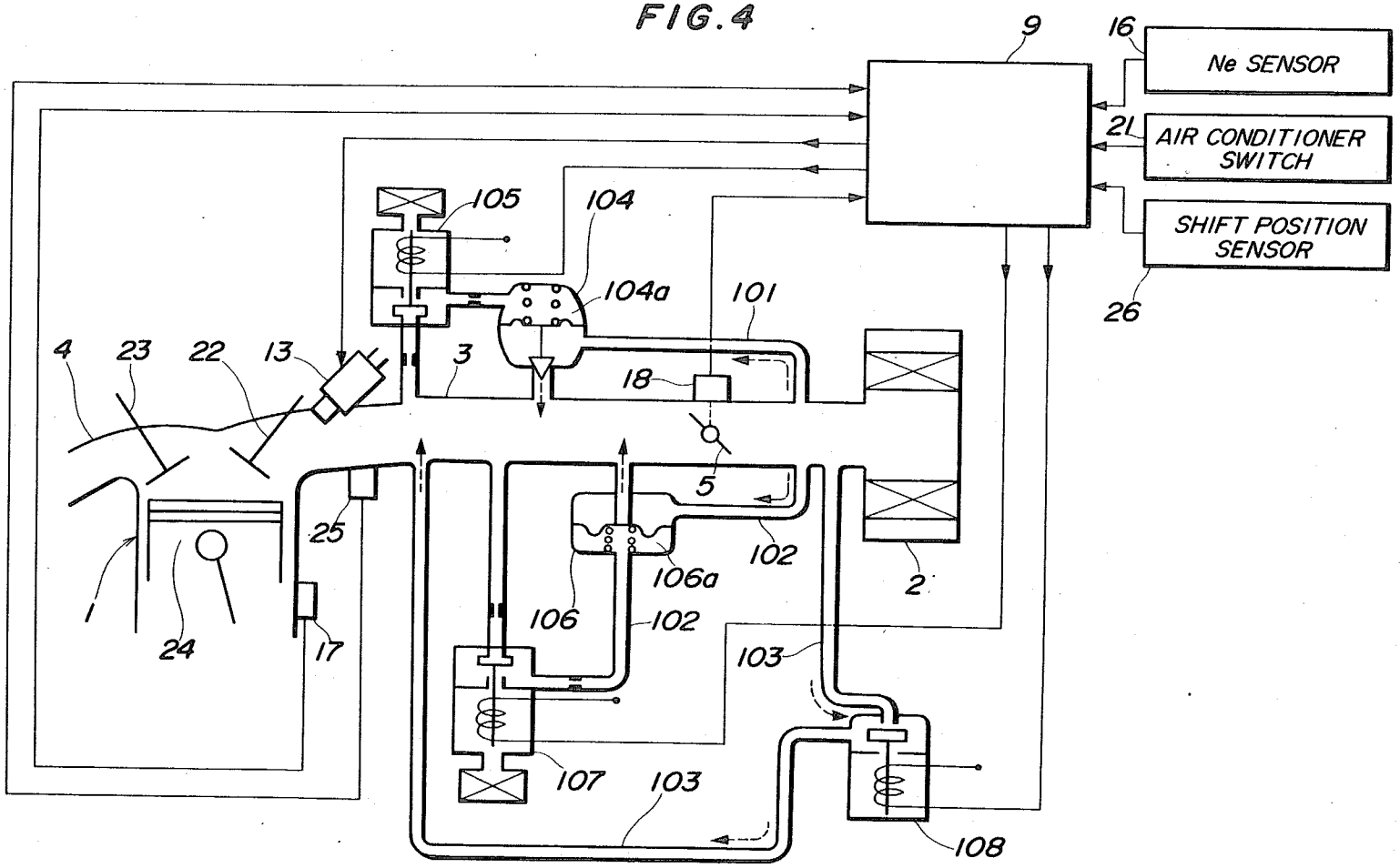
FIG. 4 is a block diagram illustrating the whole arrangement of a second embodiment of the intake air quantity control system to which is applied the method of the invention.
Figure 5:
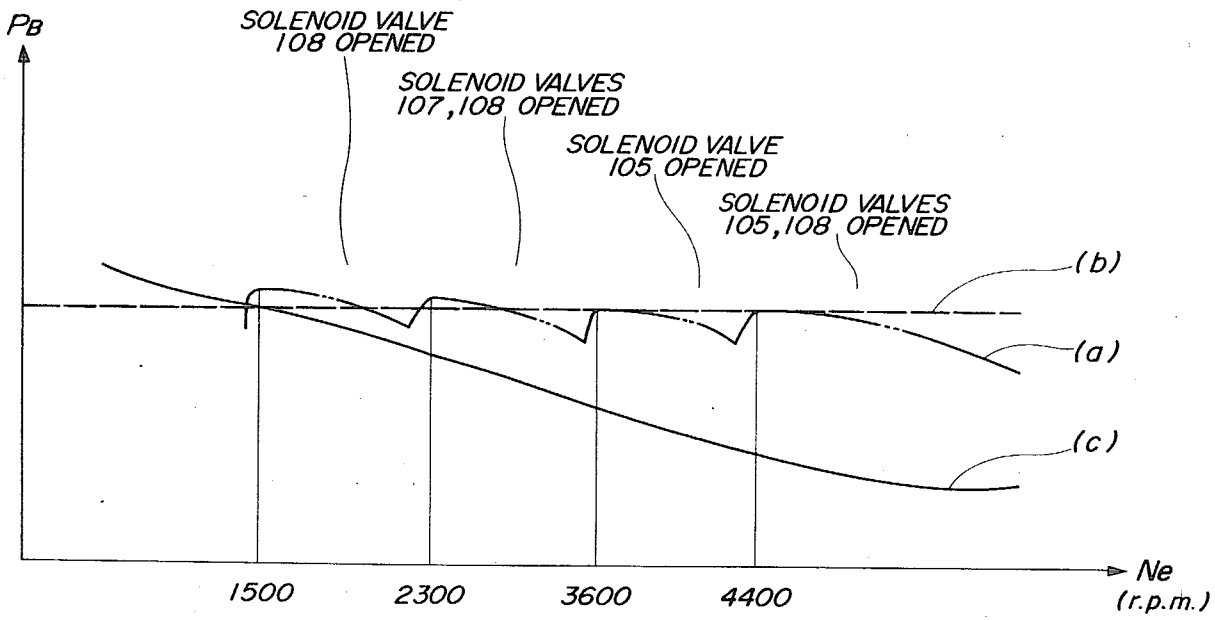
FIG. 5 is a graph showing a plurality of operating regions defined by intake pipe absolute pressure PBA and engine rotational speed Ne, based on which the intake air quantity control in deceleration vacuum control mode is effected by the control system of FIG. 4, as well as variations in the intake pipe absolute pressure PBA plotted with respect to the engine rotational speed Ne obtained by the FIG. 4 system.

Next, reference is made to FIGS. 4 and 5, to describe the arrangement of a second embodiment of a supplementary air quantity control system for an internal combustion engine, to which is applied the method of the invention.

FIG. 4 illustrates the whole arrangement of the second embodiment of the intake air quantity control system, in which elements and parts that have counterparts in FIG. 1 are designated by the same reference numerals as their counterparts.

In FIG. 4, reference numerals 22, 23, 24, and 25 designate an intake valve, an exhaust valve, a piston, and an intake air temperature (TA) sensor, respectively.

The intake air temperature sensor 25 detects a temperature (TA) of intake air being supplied to the engine 1, and applies a signal indicative of the detected temperature value to the ECU 9.

A plurality of supplementary air passages 101, 102, and 103 are connected to the intake pipe 3 in a manner bypassing the throttle valve 5. More specificallv, the passage 101 supplies supplementary air to the engine when the engine 1 is in a decelerating condition, and is provided with a vacuum-activated air valve 104 and a solenoid valve 105 disposed to control opening and closing of the air valve 104.

The passage 102 serves to allow passage of supplementary air specially for Idle Up of the internal combustion engine 1, and is provided with a vacuum-activated air valve 106 for opening and closing the passage 102, and a solenoid valve 107 disposed to control opening and closing of the air valve 106.

The passage 103 supplies supplementary air to the engine for fast idling control of the internal combustion engine 1, and is provided with a solenoid valve 108 for opening and closing the passage 103.

The passage 101 is opened by the solenoid valve 105 when the latter is energized (open), whereupon the air at the upstream side of the throttle valve 5 is supplied to the downstream side through the passage 101. More specifically, when the solenoid valve 105 is energized vacuum prevailing downstream of the throttle valve 5 in the intake pipe 3 is introduced into a vacuum chamber 104*a* of the air valve 104 to thereby open the latter 104, whereupon the air at the upstream side of the throttle valve 5 flows to the downstream side by way of the air valve 104. The capacity of the air valve 104 of this embodiment is 300 l/min. The solenoid valve 105 is connected to the ECU 9, by which it is controlled to open and close.

The passage 102 is opened by the solenoid valve 107 when the latter is energized (open), whereupon the air at the upstream side of the throttle valve 5 is supplied to the downstream side. More specifically, when the solenoid valve 107 is energized, vacuum prevailing downstream at the throttle valve 5 is introduced into a vacuum chamber 106*a* of the air valve 106 to thereby open the latter 106, whereupon the air at the upstream side of the throttle valve 5 flows to the downstream side via the air valve 106. The capacity of the air valve 106 of this embodiment is 70 l/min. The solenoid valve 107 is connected to the ECU 9, by which it is controlled to open and close.

The passage 103 is opened by the solenoid valve 108 when the latter is energized (open), whereupon the air at the upstream side of the throttle valve 5 is supplied to the downstream side via the solenoid valve 108. The capacity of the solenoid valve 106 of this embodiment is 75 l/min. The solenoid valve 108 is connected to the ECU 9, by which it has its duty ratio controlled.

The control pattern of opening and closing of the solenoid valves 105, 107, and 108, that is, the supplementary air passages 101, 102, and 103, is set such that the solenoid valves are controlled to supply supplementary air for respective proper purposes, as shown in Table 2. In addition to this the solenoid valves 107 and 108 as well as 105 are further controlled in accordance with a control schedule as shown in Table 3, too, while the engine is in the decelerating condition, similarly to the case of the

TABLE 2

| | Solenoid Valve 108 | Solenoid Valve 107 | Solenoid Valve 105 |
|---|---|---|---|
| Upon Engine Start | | | |
| Water Temp. Tw < −10° C. | ON (30 sec) | — | ON (30 sec) |
| Water Temp. −10° C. < Tw < 15° C. | ↑ | — | — |
| Water Temp. 15° C. < Tw < 33° C. | ↑ | ON (163 sec) | — |
| Water Temp. 33° C. < Tw < 40° C. | ON (7 sec) | ↑ | — |
| Water Temp. Tw > 40° C. | ↑ | — | — |
| Intake Air Temp. TA > 75° C. | ON (30 sec) | — | — |
| During Engine Warming-up | | | |
| Water Temp. Tw < −10° C. | — | ON | — |
| Water Temp. 40° C. < Tw < 70° C. | ON←→OFF | — | — |
| After Engine Warming-up (θTH Less Than 0.4°) | | | |
| Low Ne Due to Aging Or Electrical Load | ↑ | — | — |
| Shift Position Not in P Or N Ranges | ↑ | ON | — |
| Air Conditioner Switch ON | Ne less than 700 rpm | ON | — |

first embodiment. Also, the solenoid valve 105, which is provided exclusively for the supply of supplementary air when the engine is in the deceleration condition, is also opened by the ECU 9 when the engine starts at a low temperature.

TABLE 3

| Ne (rpm) Sol. | Region A' 1500–2300 | Region B' 2300–3600 | Region C' 3600–4400 | Region D' 4400 or higher |
|---|---|---|---|---|
| 108 | ON | ON | OFF | ON |
| 107 | OFF | ON | OFF | OFF |
| 105 | OFF | OFF | ON | ON |

The ON/OFF control pattern of the solenoid valves 105, 107 and 108 as shown in Table 2 is stored in the ECU 9 as a control map, according to which the ECU 9, upon processing signals inputted from the water temperature (TW) sensor 17, the intake air temperature (TA) sensor 25, the engine rotational speed (Ne) sensor 16, etc., supplies ON/OFF control signals to the respective solenoid valves 105, 107, and 108.

According to Table 2, if, for instance, the water temperature TW is lower than −10° C. when the engine 1 is started, then the solenoid valve 105 is energized for 60 seconds and the solenoid valve 108 is energized for 30 seconds, whereupon a considerable amount of supplementary air is supplied to the engine, which is mixed with a corresponding amount of fuel simultaneously supplied to make the warming-up operation stable. The solenoid valve 108 is also energized for 30 seconds and 7 seconds, respectively, when the water temperature TW is between −10° C. and 33° C., and between 33° C. and 40° C., at the start of the engine. Also, if, for instance, TW is between 15° C. and 40° C. when the engine 1 is started, then the solenoid valve 107 is energized to open the passage 102, whereupon supplementary air for Idle Up is supplied to the downstream side of the throttle valve 5. Further, if, for instance, the intake air temperature TA is higher than 75° C. when the engine is started, then the solenoid valve 108 is energized to open the passage 103, whereupon supplementary air for Idle Control is supplied to the downstream side of the throttle valve 5.

Further, in the case where the engine is not completely warmed-up yet but more than one minute has passed since the engine was started at a water temperature TW lower than −10° C., only the solenoid 107 is energized to supply a suitable amount of supplementary air so that the warming-up operation is stably controlled and promptly completed.

If the engine is not completely warmed up yet and the water temperature TW is normal, e.g. between 40° C. and 70° C., then the solenoid valve 108 is opened and closed repeatedly with a duty ratio determined in response to the actual engine rotational speed, so that the idling rotational speed is controlled to a desired value (e.g. 800–900 rpm) in a feedback manner.

Further, after completion of warming-up operation wherein normal water temperature higher than 75° C. for instance is attained, if the engine is idling with the shift position of an automatic transmission installed in the automotive vehicle being detected to be in a drive range by the shift position sensor 26, or if the engine load is increased due to operation of an auxiliary equipment such as an air conditioner, which is detected via an ON signal from the air conditioner switch 21, then the solenoid valve 107 is energized to open and simultaneously the solenoid valve 108 is opened and closed to supply a somewhat large amount of supplementary air to the engine, whereby the engine rotational speed is controlled with high precision to a desired idling rotational speed (e.g. 750 ±50 rpm) in a feedback manner.

When the engine 1 is to be controlled in the deceleration vacuum control mode, it is determined, in a similar manner to that in the case of the first embodiment, which one of operating regions A', B', C', and D' the engine rotational speed Ne lies in, the operating regions being defined, respectivelv, by a plurality of predetermined engine rotational speed values (e.g. 1500 rpm, 2300 rpm, 3600 rpm, and 4400 rpm as shown in FIG. 5). Then, in response to the operating region thus determined the solenoid valves 105, 107 and 108 are controlled in a manner shown in Table 3.

Incidentally, a similar program flow chart as the one used in the first embodiment (FIG. 3) may be adopted in determining which of the regions A' through D' the engine rotational speed Ne lies in. The solenoid valves 105, 107, and 108 correspond, respectively, to the ALV valve 10'', the HAC valve 10', and the AIC valve 10, in FIG. 1.

More specifically, in the intake air quantity control in deceleration vacuum control mode, when the engine rotational speed Ne is between 1500 rpm and 2300 rpm (i.e. in the region A') the solenoid valve 108 is energized, when Ne is between 2300 rpm and 3600 rpm (in the region B') the solenoid valves 107 and 108 are energized, when Ne is between 3600 rpm and 4400 rpm (in the region C') the solenoid valve 105 is energized, and when Ne is greater than 4400 rpm (in the region D') the solenoid valves 105 and 108 are energized, so that in each region supplementary air is supplied to the engine 1 by way of respective air passages bypassing the throttle valve 5. Hence, in this embodiment, when the engine 1 is in the region A' (1500–2300 rpm) supplementary air is supplied at a rate of 75 l/min determined by the capacity of the solenoid valve 108; in the region B' (2300–3600 rpm) 145 l/min determined by the sum of the capacities of the solenoid valves 107 and 108; in the region C' (3600–4400 rpm) 300 l/min determined by the capacity of the solenoid valve 105; and in the region D' (greater than 4400 rpm) 375 l/min determined by the sum of the capacities of the solenoid valves 105 and 108, respectively. As a result, the absolute pressure in the intake pipe 4 downstream of the throttle valve 5 is maintained high enough.

By thus on-off controlling the solenoid valves 105, 107, and 108 in the manner described above when the engine is in the decelerating condition, it is theoretically possible to control the intake pipe absolute pressure PBA so as to vary in a manner as represented by the characteristic curve (a) in FIG. 5, which is generally close to the ideal pressure curve (b) representing a substantially constant PBA value. The solid line curve (c) represents a variation in the intake pipe absolute pressure PBA with the throttle valve 5 in its fully closed position which would occur if the method of the invention is not applied. Like the curve (c) in FIG. 2, it is seen from the curve (c) in FIG. 5 that as the engine rotational speed Ne increases, the intake pipe absolute pressure PBA decreases.

In the second embodiment, when the engine 1 is in the decelerating condition, not only the passage 101 provided exclusively for supplementing air supply at engine deceleration, but also the passage 102 provided for Idle Up and/or the passage 102 provided for Idle Control are utilized to control the supply of supplementary air, depending on the engine speed assumed, but it is possible to provide an additional passage to assist the passage 101 in place of the passages 102 and 103.

Since in the second embodiment, as described above, a plurality of passages are employed to supply supplementary air to the engine when the engine 1 is in the decelerating condition, the vacuum-activated air valve 104 need not have such a large capacity and controllablity as to be capable of coping with a wide variety of engine rotational speed ranges from a low speed range to a high one, but the valve 104 has only to have a small but constant capacity, which makes the valve 104 simple in construction and compact in size. Also, since in the second embodiment, the passages provided for respective proper purposes of supplying supplementary air bypassing the throttle valve 5 at times other than engine deceleration (i.e. as the passage 102 for Idle Up and the passage 103 for Idle Control) are utilized for supplementary air supply at engine deceleration, the system can be more simple in construction and lower in cost.

Figure 6:
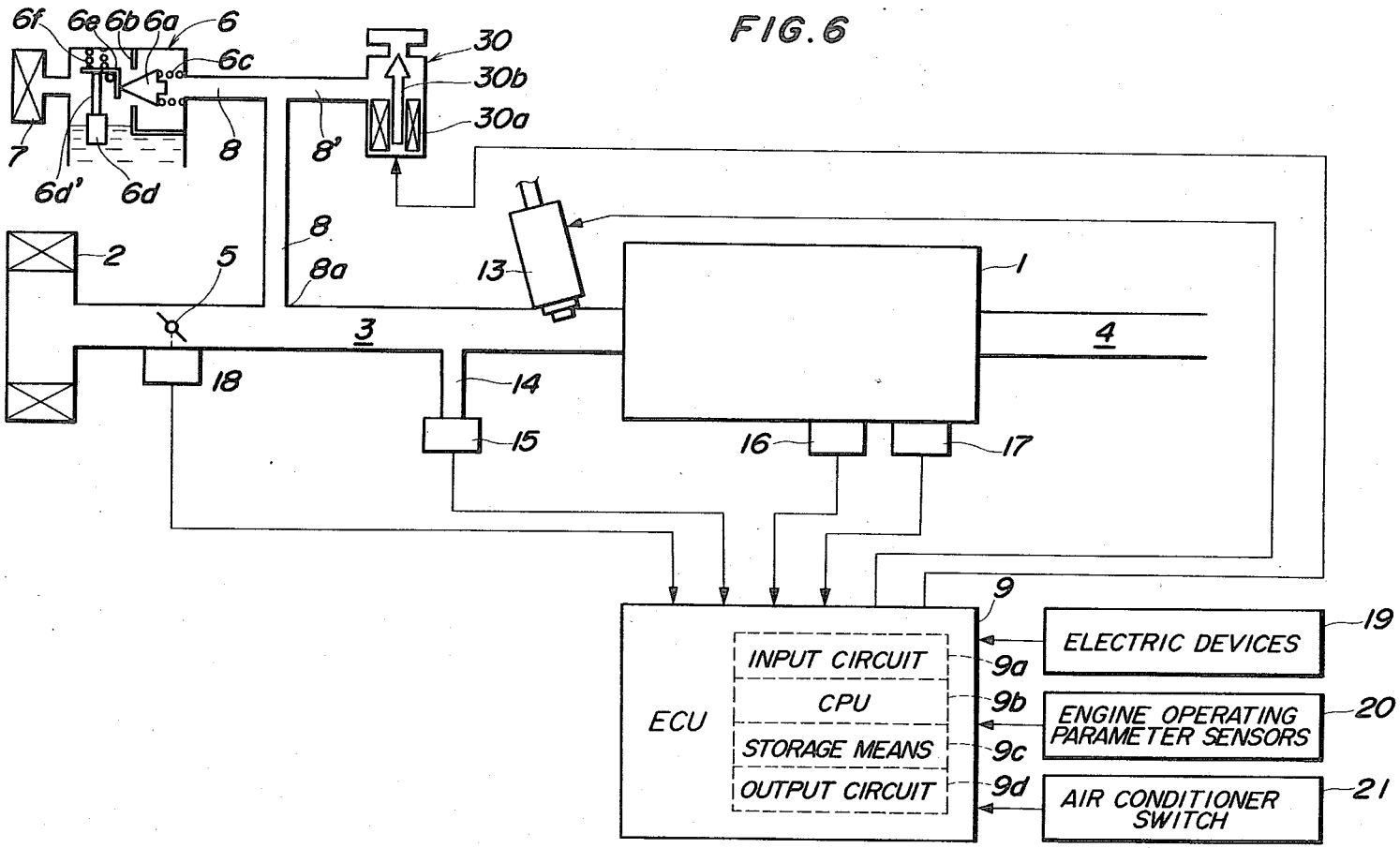
FIG. 6 is a block diagram illustrating the whole arrangement of a third embodiment of the intake air quatity control system in which the first-third supplementary air quantity control valves are superseded by a linear solenoid valve.

Next, reference is made to FIG. 6 illustrating a third embodiment wherein a linear solenoid valve is adopted as a supplementary air quantity control valve.

The FIG. 6 embodiment differs from the first embodiment (in FIG. 1) in that the the AIC valve 10, the HAC valve 10', and the ALV valve 10'' are superseded by a single linear solenoid valve 30 whose maximum capacity is not smaller than the sum of the capacities of the valves 10, 10', and 10''. Those elements in FIG. 6 that have counterparts in FIG. 1 are designated by the same reference numerals as their counterparts.

Figure 7:
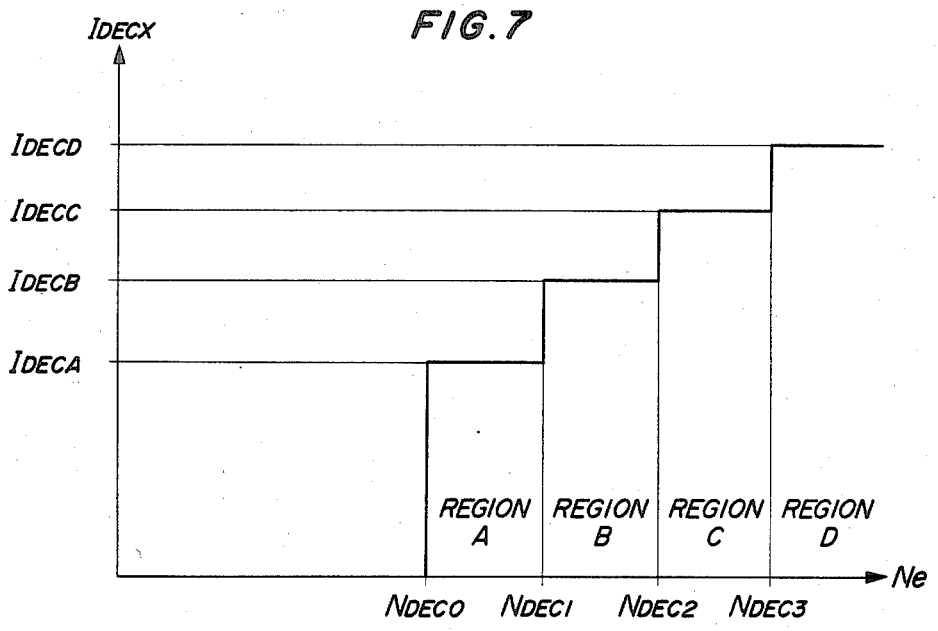
FIG. 7 is a graph showing the relationship between driving current IDECX for the linear solenoid valve in FIG. 6 and engine rotational speed Ne.

The linear solenoid valve 30 is provided, for instance, across the third supplementary air passage 8', and comprises a solenoid **30*a* and a valve body 30*b* which opens the third supplementary air passage 8' to various degrees (valve lifts) corresponding to the driving current engergizing the solenoid 30*a* connected to the ECU 9. According to this embodiment, the ECU 9 controls the driving current IDEC to be applied to the linear solenoid valve 30, to one of predetermined values IDECA–IDECD, shown in FIG. 7, in response to the result of a determination as to which of the regions A through D the engine rotational speed Ne lies in, during engine deceleration for instance, the regions A through D being already defined in the description of the first embodiment. The predetermined value IDECA is set at such a value that the amount of supplementary air supplied by the linear solenoid valve 30 energized by IDECA is the same as the amount supplied when only the AIC valve 10 of the first embodiment is opened. Similarly, the predetermined values IDECB through IDECD are respectively set at values corresponding to air amount values obtained by opening the AIC valve 10, the HAC 10', and the ALV valve 10'', singly or in combination, according to the pattern of Table 1** referred to before.

Although, in the third embodiment where the linear solenoid valve 30 is employed, the driving current is varied only to the predetermined values IDECA through IDECD in response to the regions A through B determined based on the engine rotational speed Ne, it may be arranged such that the driving current is variable in a continuous manner responsive in response to the engine rotational speed Ne.

What is claimed is:

1. A method of controlling the quantity of intake air supplied to an internal combustion engine having an intake passage, a throttle valve arranged in said intake passage, at least one supplementary air passage bypassing said throttle valve, and control valve means arranged across said at least one supplementary air passage for controlling the flow rate of supplementary air supplied therethrough to said engine, the method comprising the steps of: (1) detecting the valve opening of said throttle valve; (2) detecting the rotational speed of the engine; and (3) controlling said control valve means in a manner such that the valve opening of said control valve means is decreased with a decrease in the rotational speed of the engine, when it is determined from the detected valve opening of said throttle valve that said throttle valve is in a substantially fully closed position and at the same time the rotational speed of the engine is higher than a predetermined value which is higher than an idling speed of the engine.

2. A method as claimed in claim 1, wherein said at least one supplementary air passage comprises a plurality of air passages, and said control valve means comprises a plurality of on-off valves arranged across respective ones of said air passages, said step (3) comprising selectively opening at least one of said plurality of on-off valves such that the total opening of the opened on-off valves decreases with a decrease in the rotational speed of the engine.

3. A method as claimed in claim 2, wherein said plurality of on-off valves have opening areas different from each other.

4. A method as claimed in claim 2 or claim 3, wherein said plurality of on-off valves each comprise a solenoid and a valve body being displaceable in response to whether or not said solenoid is engergized.

5. A method as claimed in claim 2 or claim 3, wherein at least one of said plurality of on-off valves is a vacuum-activated valve.

6. A method as claimed in claim 2 or 3, further comprising a step of selectively opening at least one of said plurality of on-off valves in response to an extent to which the engine has been warmed up.

7. A method as claimed in claim 6, further comprising a step of selectively opening at least one of said plurality of on-off valves in response to an increase in a predetermined load on the engine.

8. A method as claimed in claim 1, wherein said control valve means comprises a linear solenoid valve.

* * * * *